United States Patent [19]

Leonard

[11] Patent Number: 4,532,968

[45] Date of Patent: Aug. 6, 1985

[54] ROTARY FILLING APPARATUS AND METHOD

[75] Inventor: George E. Leonard, Bettendorf, Iowa

[73] Assignee: The Kartridg Pak Co., Davenport, Iowa

[21] Appl. No.: 507,087

[22] Filed: Jun. 23, 1983

[51] Int. Cl.[3] ..... B65B 3/04

[52] U.S. Cl. ..... 141/5; 141/94; 141/145; 141/DIG. 1

[58] Field of Search ..... 141/1-12, 141/129-191, 198, 250-284, 34, 94-96, DIG. 1

[56] References Cited

U.S. PATENT DOCUMENTS

| | | | |
|---|---|---|---|
| 2,754,082 | 7/1956 | Crandall | 141/283 |
| 2,949,941 | 8/1960 | Mojonnier | 141/141 |
| 3,043,349 | 7/1962 | Bennett | 141/198 |
| 3,316,945 | 5/1967 | Brinkley et al. | 141/140 |
| 3,426,812 | 2/1969 | Brinkley et al. | 141/140 |
| 3,545,170 | 12/1970 | Leonard | 53/88 |
| 3,835,898 | 9/1974 | Leonard | 141/152 |
| 3,857,424 | 12/1974 | Roberts | 141/275 |
| 4,086,741 | 2/1978 | Williams | 53/88 |

*Primary Examiner*—Houston S. Bell, Jr.

*Attorney, Agent, or Firm*—Lockwood, Alex, Fitzgibbon & Cummings

[57] ABSTRACT

A rotary filling apparatus is provided that is of the type which uses gravity to fill liquids into a plurality of containers while they rotate about a rotary filling head. The apparatus includes a level control chamber having a sensor that is disposed from the axial center of the apparatus a distance that is substantially the same as that between this axial center and the nozzle through which the liquids are dispensed into the container, so that the centrifugal force at the sensor is substantially the same as that at the dispensing nozzle when the rotary head is rotated during the filling operation in order to maintain a substantially constant hydraulic head during operation.

22 Claims, 11 Drawing Figures

85
86
70
27
60
21
29
63
64
28
28
64
61
61
26
26
62
59
52
52
32
36
36
22
41
41
66
66
40
67
57
57
54
56
58
58
24
50
50
55
53
47
49

ROTARY FILLING APPARATUS AND METHOD

BACKGROUND AND DESCRIPTION OF THE INVENTION

This invention generally relates to rotary filling machines, more particularly to an apparatus and method having various features for precisely controlling the fill level delivered to the containers being filled on a rotary head, including a sensor that is positioned from the central axis of the rotary head at a distance that is substantially the same as that between this central axis and each fill nozzle. Also included are control assemblies to maintain the desired level within the liquid reservoir and to adjust the fill time while the apparatus is in operation. Other features include improved explosion-proofing by protecting electronic components within air-purged environments, structural features for facilitating machine clean-up without dismantling same, more consistent liquid flow through the fill nozzles, and features for readily adjusting the height of the rotary head for accommodating various different sizes of containers to be filled.

Rotary fillers have been known for filling containers with a liquid product, including the filling of aerosol containers with liquid product to be packaged with a propellant. Representative of the general type of apparatus that is used for filling liquid components and products is that shown in U.S. Pat. No. Re. 23,830, wherein a rotating turntable having a plurality of operating stations receives a flow of containers which are filled with liquid while the containers move along the rotating turntable.

In these types of operations, it is typically very important to accurately and closely control the amount of liquid that is fed into each container. Such is important to avoid a shortfall of product filled into the container, to avoid product waste, and to insure that the proper amount of space is available for subsequent filling of the propellant thereinto when desired. One difficulty that has been encountered over the years in this regard is the fact that these rotary heads are rotating while the filling mechanism is in operation, which causes the development of forces such as centrifugal forces that affect the metering of liquids while they are passed through the rotary head. Particularly troublesome is the fact that these forces will vary with the speed at which the rotary head is operating, which typically will vary at differing points of the filling operation, for example, when the rotary head must be slowed or stopped in order to accommodate a subsequent operation. Most of these types of variations are not predictable, and it is difficult for an operator to anticipate when a fill level adjustment might be needed.

Another difficulty with these types of devices is attempting to adjust the fill level while the containers are traversing their path along the rotating turntable. Additionally, in certain instances, expensive and cumbersome explosion-proof cabinetry and components are incorporated as a safety measure, which may be important depending upon the contents being filled into the containers.

Often, with these types of rotary filling machines, particularly that portion of the machinery which adds the liquid component, it is necessary to clean out the various passageways through which the liquid product flows before changing over to a different liquid product. For example, when the liquid being filled is a paint, it is necessary to clean these passageways when changing from one color to another, even though the propellant subsequently added may be exactly the same for any such color. Typically, such a clean up operation involves disassembling at least a portion of the device in order to treat same with solvents and the like.

The present invention responds to these various needs and difficulties by various features which combine to provide a constant hydraulic head that is adjustable while the device is in operation, such including providing a sensor that is located substantially the same distance from the axial center of the rotary turntable as is the opening through which the liquid flows into each container that is being filled. An alignment and trough arrangement are also provided in association with a head raising and lowering assembly whereby cleaning of the liquid passageways can be carried out on a generally automatic basis. Suitable cabinetry and fluid flow mechanisms are provided in order to explosion-proof the device.

It is accordingly a general object of the present invention to provide an improved rotary filling device.

Another object of the present invention is to provide an improved rotary filling device having a substantially constant hydraulic head in order to minimize the effects of variations in centrifugal force on the liquid while the device is being operated.

Another object of this invention is to provide means for adjusting the fill size at any station of a rotary filling device while that device is in operation.

Another object of the present invention is to provide an improved rotary filling device which includes a sharp-edged orifice nozzle design for enhancing fill consistency.

Another object of the present invention is to provide an improved rotary filling device having a pneumatic nozzle actuation feature for more reliable nozzle opening and closing procedures.

Another object of the present invention is to provide an improved rotary filling device having clean-in-place capability that avoids the need to disassemble components in order to clean the liquid flow passageways thereof.

Another object of the present invention is to provide an improved rotary filling device having a simplified and easy-to-operate means for adjusting the gang head height.

Another object of the present invention is to provide an improved rotary filling device that utilizes air purging at air-electrical interfaces in order to eliminate the necessity for explosion-proof electrical wiring and components.

These and other objects and features of the invention will be apparent from the following detailed description, taken in conjunction with the accompanying drawings, wherein.

Figure 1:
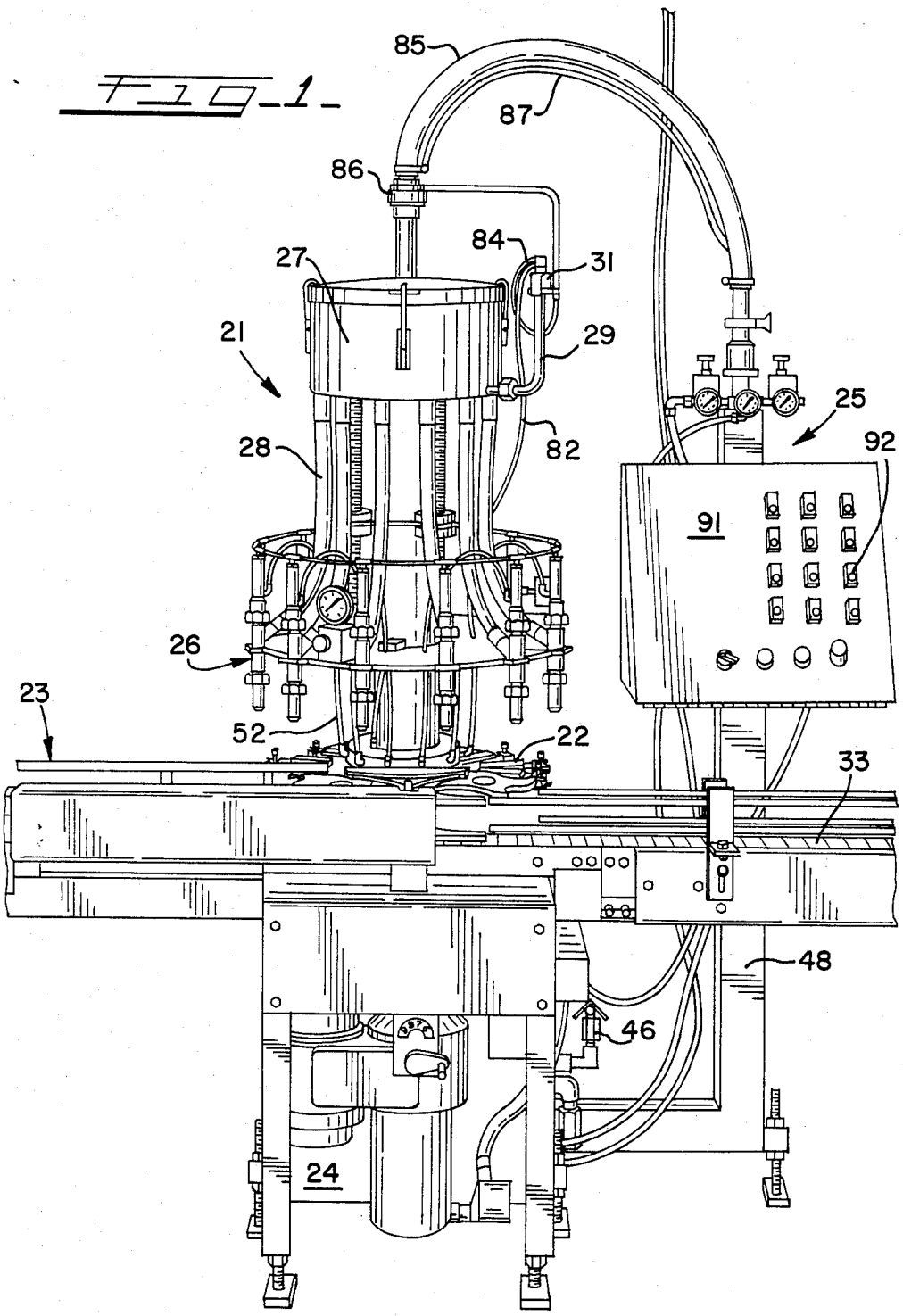
FIG. 1 is a perspective view of the preferred rotary filling device in accordance with this invention.

Referring to FIG. 1, a rotary filling apparatus according to this invention includes a rotary dispensing assembly, generally designated as 21, a rotating turntable 22, a conveyor assembly 23, and a cabinet 24 and a remote control assembly 25, both of which are preferably air-purged.

The rotary dispensing assembly 21 includes a plurality of dispensing heads 26, a reservoir bowl 27, and a plurality of fill conduits 28 therebetween. A level control chamber 29 is in liquid passing communication with the reservoir bowl 27, and a level sensor 31 is mounted thereon. The level sensor 31 is positioned such that the radial distance between the central axis of the rotary dispensing assembly 21 and the sensor 31 is substantially the same as the radial distance by which each dispensing head 26 is spaced from this axis of the rotary dispensing assembly 21.

Figure 3:
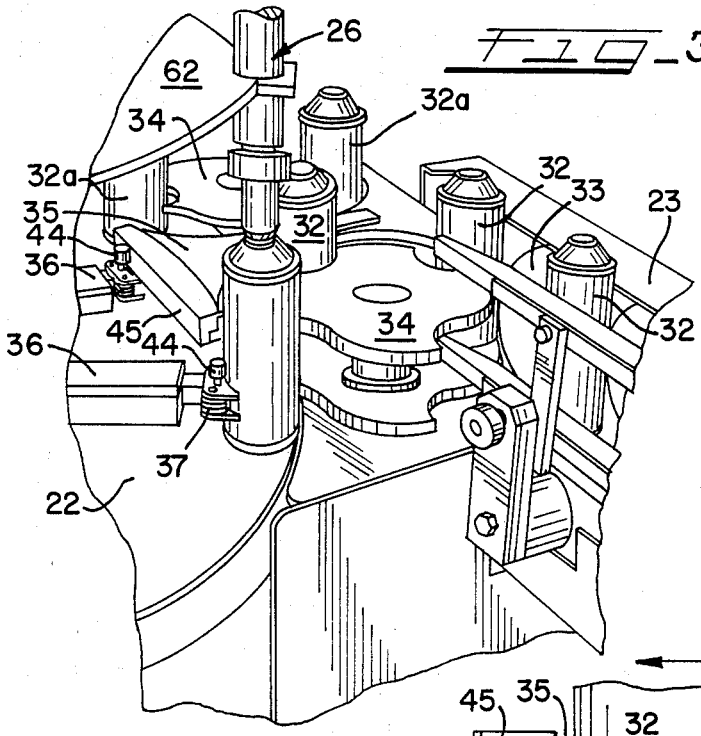
FIG. 3 is a detailed, perspective view of the mechanism by which containers are fed to and away from the rotary turntable of the device.

Conveyor assembly 23 is of a generally known construction for feeding containers 32 to and from the rotary turntable 22. As illustrated in FIG. 3, such includes a worm member 33 or the like for conveying the containers 32 to and from a star wheel 34. A fixed center infeed guide 35 guides the containers 32 being moved by the star wheel 34 onto the rotating turntable 22. A container securement arm assembly 36 assists in holding the container 32 in place as it rotates along with the turntable 22 for filling thereof. Thereafter, filled containers 32*a* are returned to the conveyor assembly 23 for transport to a subsequent station (not shown).

Figure 4:
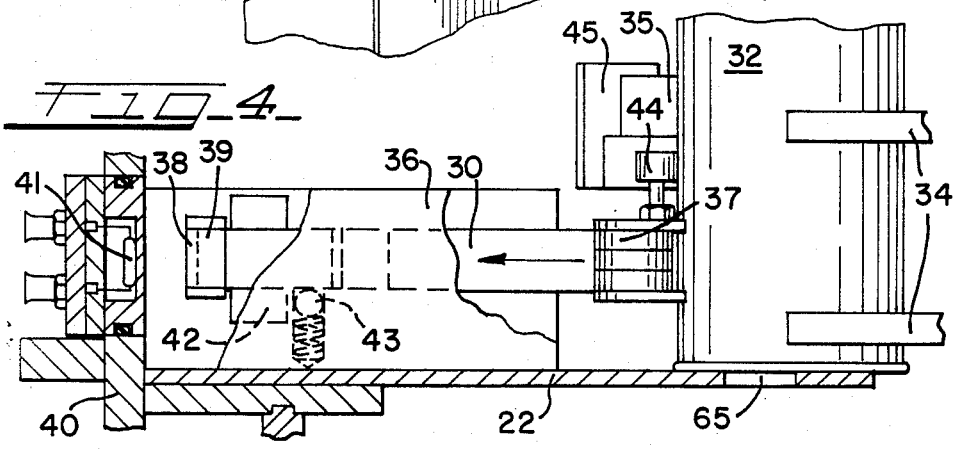
FIG. 4 is a further detailed partial sectional view of the preferred container holding and releasing mechanism in accordance with this invention, showing the device while the container is being grasped and moved toward its filling orientation.
Figure 5:
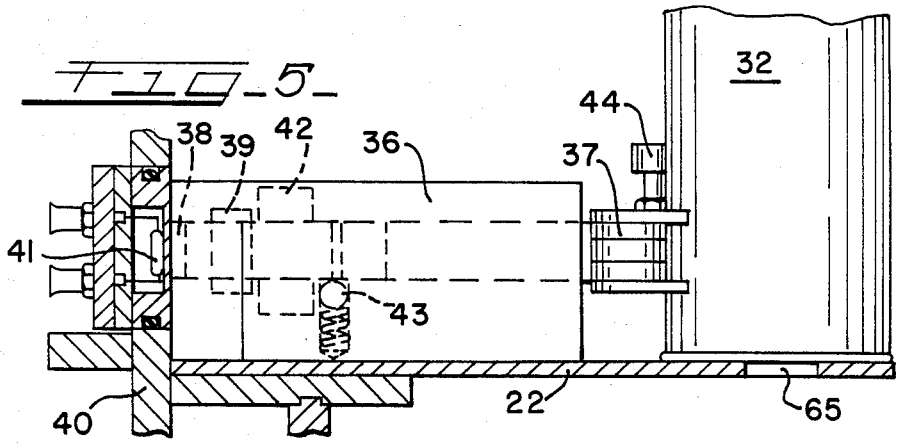
FIG. 5 is a sectional view similar to FIG. 4, illustrating this mechanism after the container has been fully grasped and is at its filling orientation.

With more particular reference to the container arm securement assembly 36, a preferred embodiment thereof is illustrated in FIGS. 4 and 5. A rigid arm 30 mounts a slidable magnet assembly 37 to hold container 32 in place on the rotating turntable 22 when assembly 37 is at the orientation illustrated in FIG. 5. The slidable magnet assembly 37 grasps the container 32 when oriented as illustrated in FIG. 4 which is at the location of rotation that is immediately past the center infeed guide 35 and at which the star wheel 34 pushes the container 32 onto the magnet assembly 37. Continued rotation of the star wheel 34 pushes the magnet assembly 37, the rigid arm 30 and an activator magnet 38 to the position shown in FIG. 5.

Before this movement, the activator magnet is spaced from a wall of turret 40 (FIG. 4). If desired, the magnetic field of the activator magnet 38 is collapsed by a shunt 39. After this movement, the activator magnet 38 is closer to a reed switch 41 of known construction, which is enclosed within the air purged cabinet 24 (FIG. 2) on the other side of the wall of turret 40, which is non-magnetic. By virtue of this close proximity between the reed switch 41 and the activator magnet 38, the reed switch is activated in order to signal that the container 32 is correctly positioned under a dispensing head 26 for subsequent filling of the container 32. An appropriate stop arrangement, such as a bumper stop 42 and a detent 43 provide holding forces in opposition to centrifugal forces that are developed while the turntable 22 rotates.

Each container arm securement assembly 36 includes a cam follower 44 for camming engagement with a cam member 45 of the fixed center infeed guide 35. As shown in FIG. 3, the camming engagement assists in separating the slidable magnet 38 from the reed switch 41. This camming engagement ceases before the container arm securement assembly 36 is in alignment for grasping a container 32 to be filled.

Figure 2:
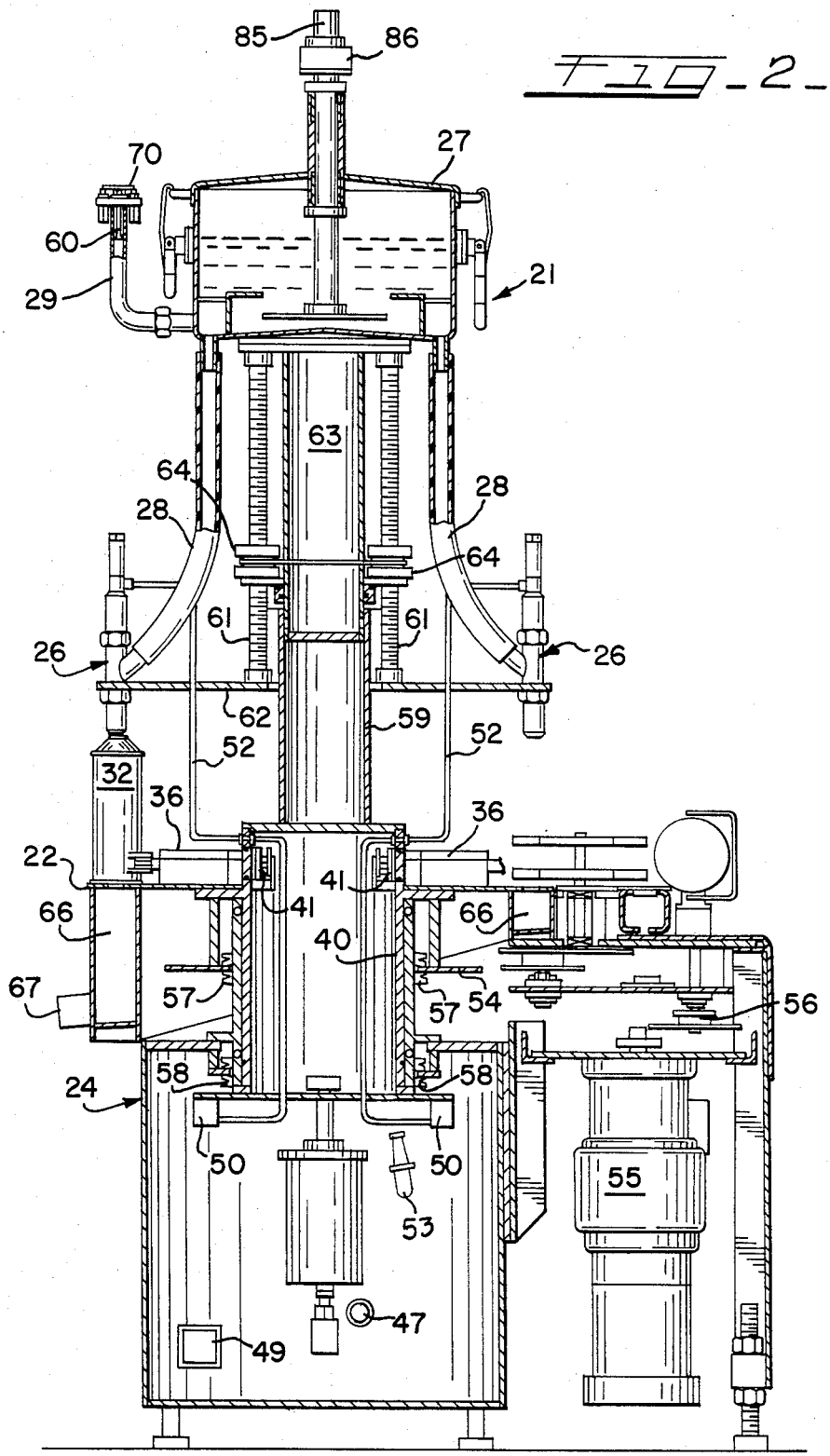
FIG. 2 is a generally vertical sectional view through various components of the rotary turntable and head of the device illustrated in FIG. 1.

With more particular reference to the air purging features of the apparatus, an exhaust check valve 46 (FIG. 1) is provided within the cabinet 24 through an appropriate orifice 47 (FIG. 2). Air enters the cabinet 24 from a plurality of locations in order to assure that, while the apparatus is operating, air is the only gas within the cabinet 24, and any possible explosive or otherwise undesirable gases are purged from the cabinet 24, as well as from the cabinetry of the remote control assembly 25. Air seeping into the remote control assembly 25 is drawn out of this cabinet through a conduit 48 (FIG. 1), which enters the air purged cabinet 24 through an opening 49 (FIG. 2). This air flow maintains an air-purged condition within the remote control assembly cabinet 25 after initial purging has been carried out.

Similarly, air flows into the cabinet 24 through air lines 52; more particularly the air returning from the dispensing head 26 is exhausted into cabinet 24 at each head control valve 50. More intensive, initial purging is carried out by virtue of a purge air nozzle 53. Typically, pressurized air will enter through the purge nozzle 53 when needed, for example before the unit is first started up, in order to circulate a large flow of relatively rapidly moving air throughout the turret 40, the entire cabinet 24, and the cabinetry for the remote control assembly 25, such flow being exhausted through the orifice 47 and the exhaust valve 46. Preferably, as illustrated, the purge air nozzle 53 is generally directed toward the reed switches 41. It is important to note that there is no dynamic opening between each reed switch 41 and each securement assembly 36, thereby precluding any possibility of having undesirable gases contact the reed switch 41 while the turret 40 remains purged.

Appropriate circuitry is provided, including devices such as rotometers, pressure gauges and pressure switches, in order to thereby monitor the air pressure within the air purged cabinet 24 and the remote control assembly 25. Such circuitry cuts off operating power to the apparatus when such air pressure drops below a predetermined limit.

The turret 40 is structured such that it rotates about a vertical axis that is coaxial with that of the rotary dispensing assembly 21. More particularly, the turret 40 and the rotating turntable 22 are mounted onto a rotating sprocket 54. The turret 40 and rotating turntable 22 are driven by a suitable arrangement, such as one including a motor 55 and a drive assembly 56. Suitable face seals 57, 58 are provided in association with the rotatable mounting of the turret 40.

Rotary dispensing assembly 21 is mounted onto a lift cylinder 59 having threaded rods 61 and a head plate 62 mounted thereto. A lifting ram 63 raises and lowers the head plate 62 along the lift cylinder 59. Positioning of the height of the head plate 62 and the dispensing heads 26 mounted thereon can be accomplished by rotating hand limit nuts 64. By this structure, the height of the dispensing heads 26 can be readily and rapidly adjusted to accommodate containers 32 having a variety of differing heights.

Figure 6:
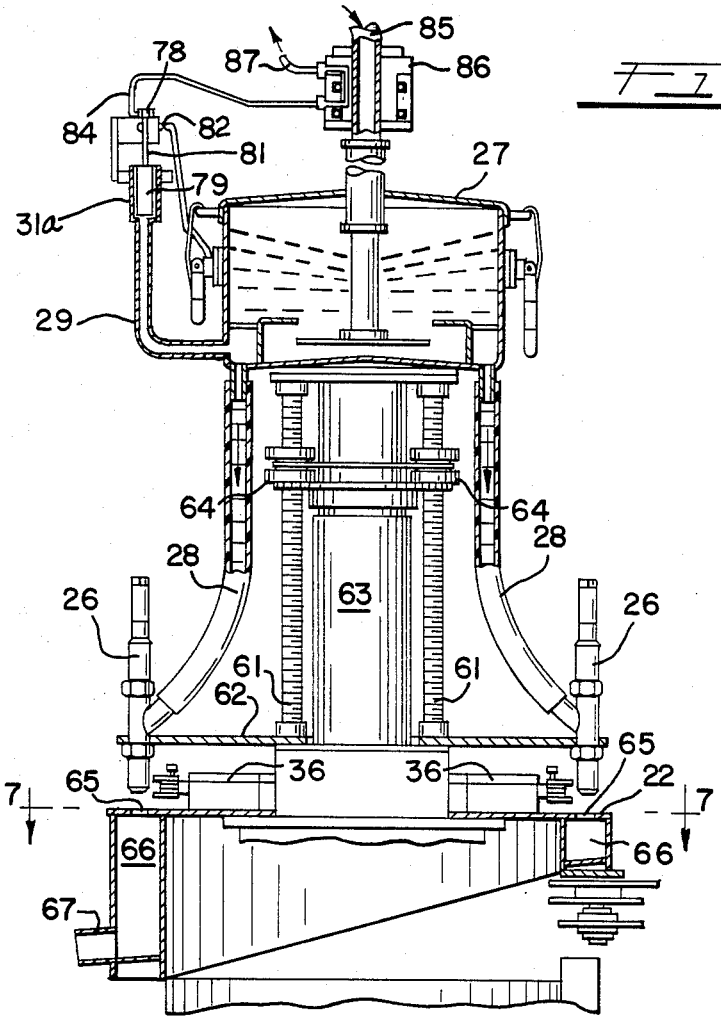
FIG. 6 is a sectional view of the rotary head and associated cabinetry thereunder, showing the device in its cleaning mode, whereby solvents or the like may be passed through the liquid-contacting passageways of the apparatus.
Figure 7:
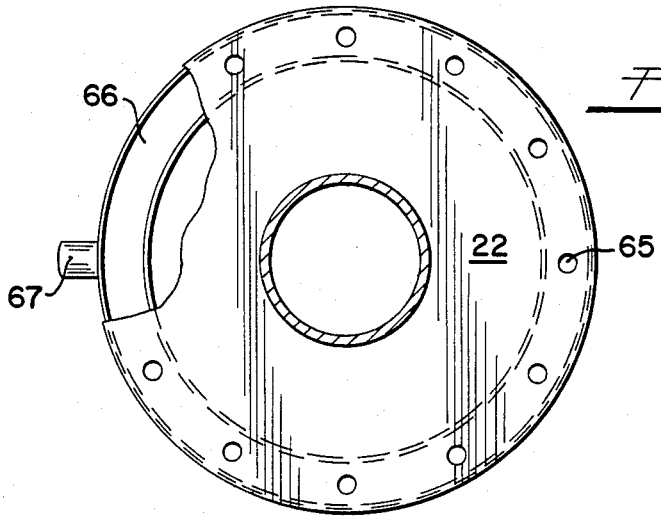
FIG. 7 is a plan view, partially broken away, along the line 7—7 of FIG. 6.

This structure also permits the dispensing heads 26 to be lowered until they substantially contact or are positioned within respective holes 65 in the turntable 22, as generally depicted in FIG. 6. When the dispensing heads 26 are thus positioned, it is possible to readily clean the various passageways of the apparatus through which the liquid being filled into the containers 32 passes in order to thereby readily and simply clean such passageways. This feature is further facilitated by the provision of a peripheral trough 66. Preferably, trough 66 has an inclined bottom surface whereby all of the fluid flowing into the peripheral trough 66 flows through an exit port 67. If desired, the liquid flowing out of the exit port 67 can be recirculated to the reservoir bowl 27 for subsequent recirculation through the system.

Figure 8:
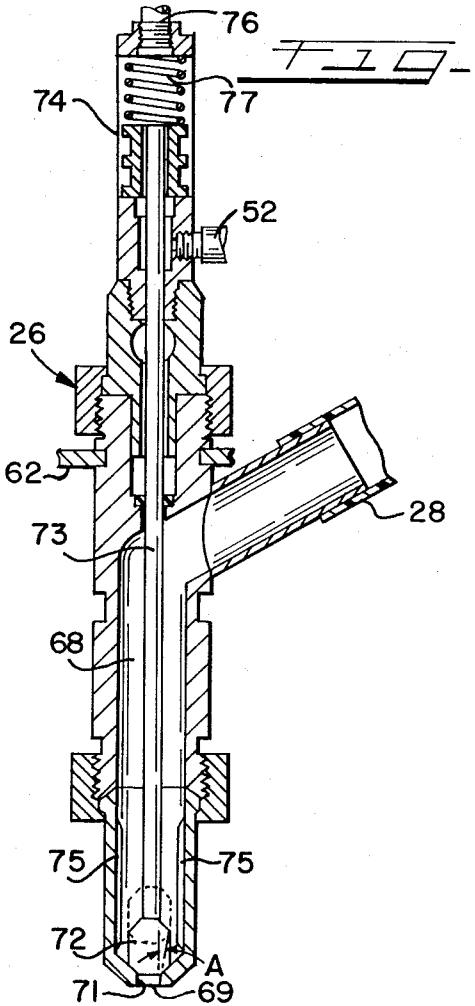
FIG. 8 is a detailed, sectional view of the dispenser valve at each station of the rotary device by means of which the liquid product passes into the containers being filled.

More particular details of the preferred dispensing head 26 are illustrated in FIG. 8. Liquid to be filled into the containers 32 flows through the fill conduit 28 and through a bore 68 for eventual passage therefrom through a nozzle orifice 69. Preferred nozzle orifice 69 has sharp-edged characteristics in order to impart enhanced laminar flow properties and flow precision to the liquid passing through the nozzle orifice 69. The annular wall 71 of the preferred orifice 69 is not right cylindrical, but has a truncated conical configuration. A typical sharp-edged annular wall 71 has a taper angle A on the order to about 5 to 20 degrees, for example approximately 10 degrees. When the annular wall 71 is untapered in this regard, turbulence is generated, and the amount of liquid filled can vary by as much as ±40 grams in 300 grams of liquid that enters the container 32. The sharp-edged annular wall 71 significantly reduces the turbulence to the extent that the quantity of liquid filled into the container during a particular run varies at more on the order of ±0.5 grams in 300 grams of liquid filled into the container 32.

A poppet 72 is mounted onto a slidable shaft 73, and movement of the shaft 73 is effected by a pneumatic cylinder 74. Preferably, the poppet 72 has a very moderate resilience, for example being made of a filled polymer, rather than a metal. Also, the bore 68 may include suitable flutes 75 for enhancing movement of the poppet 72 to and away from the nozzle orifice 69. Preferably, such flutes 75 are located at the nozzle end of the bore 68. The pneumatic cylinder 74 effects extremely positive-acting and reliable opening and closing of the nozzle orifice 69. Pneumatic cylinder 74 preferably includes downwardly directed biasing neans in order to reduce the complexity of the valving of the cylinder 74 and to enhance the responsiveness of the pneumatic cylinder 74. Such biasing means can take the form of pressurized air entering through line 76 and/or a spring 77 (illustrated in phantom) or the like.

With more particular reference to the level control chamber 29 and to the level sensor 31 thereof, the level sensor 31 provides pneumatic sensing of the level of liquid within the level control chamber 29 in order to thereby signal appropriate circuitry to control the volume of liquid entering the bowl 27. Level sensor 31 may take the form of a cone jet sensor (illustrated in FIGS. 2 and 11) of generally known construction, preferably in association with a tube 60 and a disc 70. The cone jet sensor aspirates and pressurizes in response to flow through an annular orifice.

An alternative structure of the level sensor is illustrated in FIG. 6. This level sensor **31*a* includes a sensor poppet 78 on top of a float 79 mounted onto an axial rod 81. Liquid within the reservoir bowl 27 is allowed to flow into the level control chamber 29 and to the level sensor 31*a*. When liquid within the level sensor 31*a* rises above a predetermined height, the poppet 78 is raised, thereby permitting low pressure air from inlet restrictor 82 to pass to exhaust by flowing upwardly along the length of the float rod 81. A pneumatic signal proportional to the liquid level in bowl 27 is thus sensed to line 84**.

Figure 9:
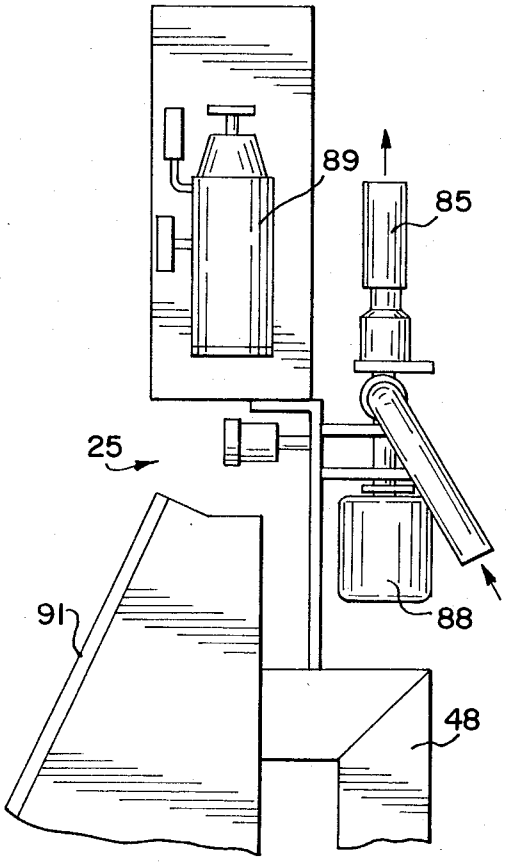
FIG. 9 is an elevational view of a portion of the preferred product flow control mechanism.

With more particular reference to the mechanism for controlling the level of liquid within the reservoir bowl 27, such liquid flows thereinto through a stationary product tube 85 that is mounted within a rotary union 86. The air signal passing from the outlet 84 of the level sensor 31, **31*a* is transmitted through tubing 87 which runs to the control assembly 25 (FIGS. 1 and 9). A liquid product control valve 88 controls the actual flow of product through the stationary product tube 85. This liquid product control valve 88 is regulated by an automatic valve controller 89, such as a Nullmatic controller (Moore Products Co.). A control panel 91 includes a plurality of potentiometers 92 for accurate adjustment of the fill level. The fill level is the amount of liquid product that passes through the nozzle orifice 69 of each respective dispensing head 26. Suitable circuitry is provided within the control panel 91 for precisely adjusting the time during which each respective pneumatic cylinder 74 (FIG. 8) raises each respective poppet 72 away from its respective nozzle orifice 69**, even while the apparatus is in operation.

Figure 11:
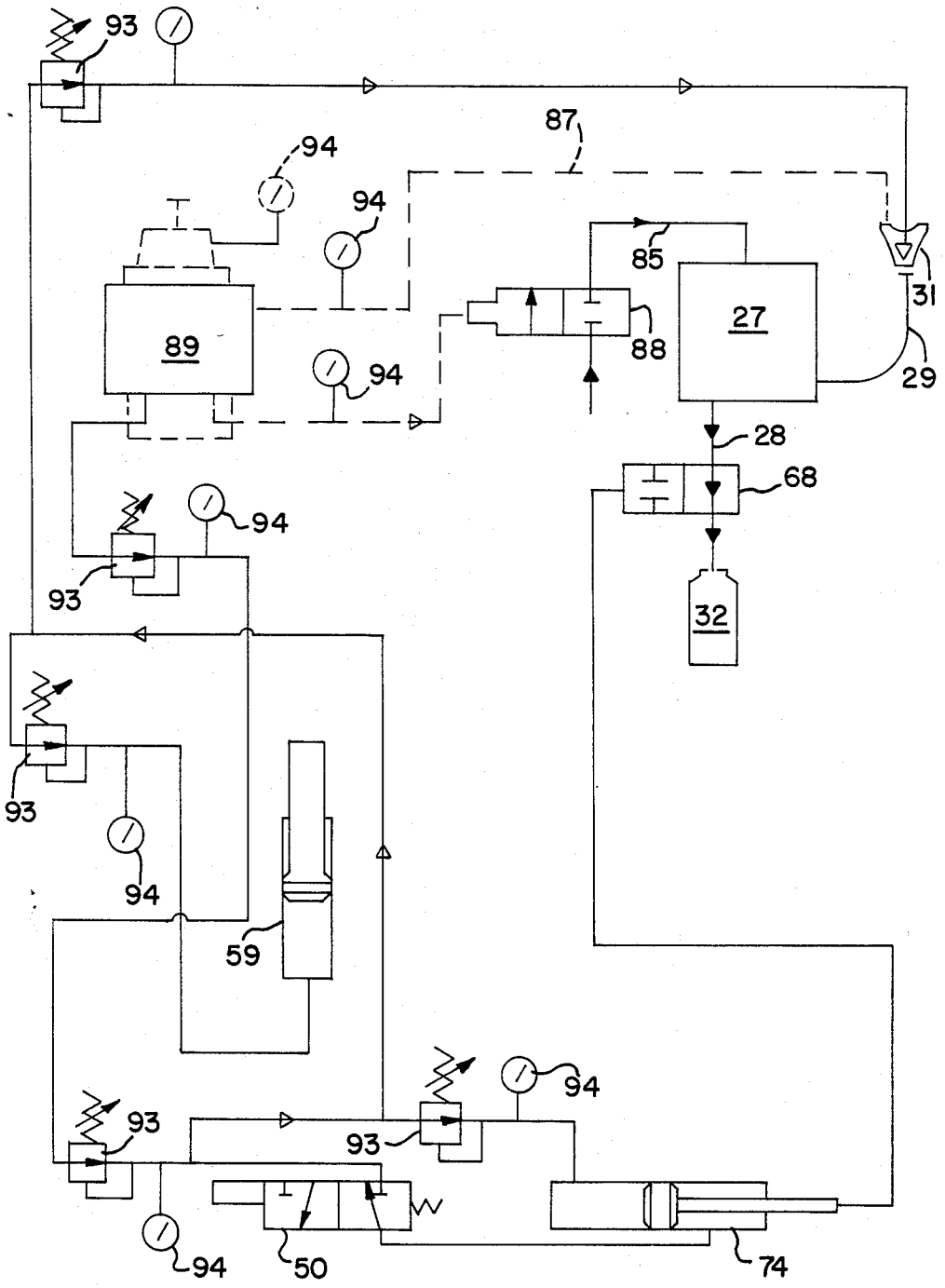
FIG. 11 is a schematic view of the principally pneumatic circuitry used in this device.

The pneumatic circuitry of the apparatus is schematically illustrated in FIG. 11, from which various actuation and control interrelationships are illustrated. It can be seen that the automatic valve controller 89 receives a signal, typically involving a change in air pressure, from the level sensor 31, which itself is activated by liquid product passing thereinto from the reservoir bowl 27 in response to the height of liquid therewithin. It will be appreciated that, in accordance with an important aspect of this invention, this liquid product level that triggers the level sensor 31 is generated in part by centrifugal forces on the liquid product while the reservoir bowl 27 and the level control chamber 29 are rotating.

In response to this signal from the level sensor 31, the automatic valve controller 89 imparts a signal, such as a change in air pressure, to the liquid product control valve 88 to permit a controlled amount of liquid product to pass through the stationary tubing 85 and into the reservoir bowl 27 in order to maintain the liquid height that will develop the gravitational forces needed to pass the desired amount of liquid product through the fill conduit 28 and the bore 68 into the container 32 that is being filled. This passage into the container 32 is controlled by the pneumatic cylinder 74, which is in turn activated by the control valve 50. Appropriate sensor regulators 93 and gauges 94 are provided to monitor this circuitry.

Figure 10:
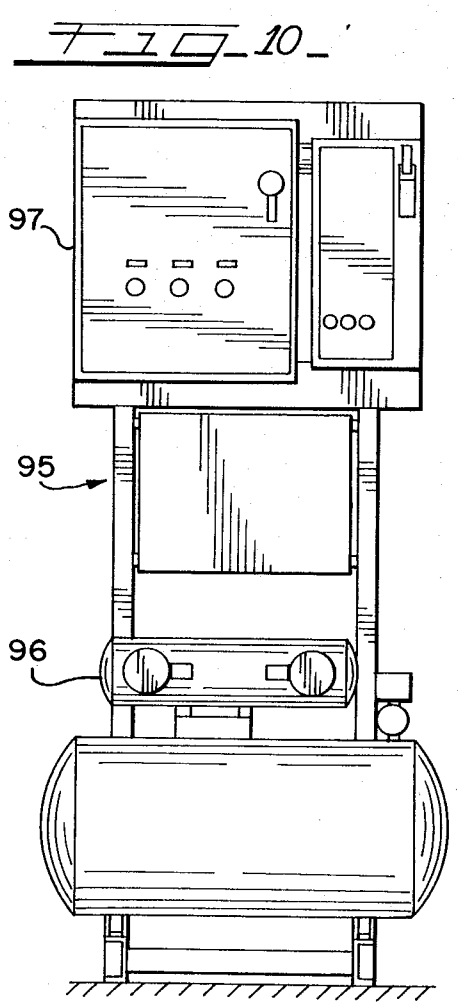
FIG. 10 is an elevational view of a remotely located control enclosure for the device according to this invention.

FIG. 10 illustrates a remote support assembly 95 that is located within a non-hazardous area. Assembly 95 includes an air compressor, which is capable of providing compressed air that is of instrument quality, together with suitable controls 97 for the compressor, its motor and starter.

It will be understood that the embodiments of the present invention which have been described are merely illustrative of a few of the applications of the principals of the present invention. Numerous modifications may be made by those skilled in the art without departing from the true spirit and scope of the invention.

What is claimed is:

1. A rotary filling apparatus of the type which uses gravity for filling a liquid into a plurality of containers while they rotate about a rotary filling head, the apparatus comprising:

a rotary dispensing assembly rotatably mounted along a generally vertical central axis, said rotary dispensing assembly including a liquid reservoir bowl and a dispensing nozzle through which the liquid is dispensed, and said nozzle is spaced a predetermined distance from said central axis;

a level control chamber in liquid passing communication with said liquid reservoir bowl, said level control chamber having a liquid level sensor that is spaced from said central axis by a distance that is substantially the same as said predetermined distance such that centrifugal force at the liquid level sensor is substantially the same as that at said nozzle when the rotary dispensing assembly is rotated during filling in order to maintain a substantially constant hydraulic head during operation, and said liquid level sensor monitors and controls the amount of liquid within the level control chamber;

a turntable including means for positioning each container to be filled at a location below and closely spaced from said dispensing nozzle; and means for controlling the opening and closing of said dispensing nozzle when the container to be filled is positioned thereunder.

2. The rotary filling apparatus of claim 1, wherein said turntable includes securement arm means for grasping the container supported on the turntable.

3. The rotary filling apparatus of claim 2, wherein said securement arm means includes a slidable magnet assembly and a magnetically activated switch.

4. The rotary filling apparatus of claim 1, further including a turret centrally located with respect to the turntable and securement arm means having a slidable assembly mounted exteriorly of said turret and a switch mounted interiorly of said turret.

5. The rotary filling apparatus of claim 1, further including a turret associated with said turntable and securement arm means having a magnetic assembly mounted exteriorly of said turret and a reed switch mounted interiorly of said turret.

6. The rotary filling apparatus of claim 1, further including a fixed infeed guide having a cam surface and securement arm means on said turntable, said securement arm means including a cam follower that engages said cam surface at a filled container exit location of the turntable.

7. The rotary filling apparatus of claim 1, wherein all electrical interfaces of the apparatus are included within an enclosed chamber that is under a positive pressure of a non-explosive gas.

8. The rotary filling apparatus of claim 1, further including a turret and associated cabinetry, said turret and cabinetry being generally closed except for gas purging orifices.

9. The rotary filling apparatus of claim 1, further including a turret and wherein said rotary dispensing assembly, said turntable and said turret are coaxial.

10. The rotary filling apparatus of claim 1, wherein said rotary dispensing assembly is mounted onto a gang lifting assembly.

11. The rotary filling apparatus of claim 1, wherein said turntable includes a hole therethrough in general alignment with the dispensing nozzle and a liquid receiving trough thereunder, and wherein said rotary dispensing assembly includes means for lowering same for movement of the dispensing nozzle to said hole.

12. The rotary filling apparatus of claim 1, wherein said dispensing nozzle includes a sharp-edged nozzle orifice through which liquid flows out of the dispensing nozzle and into the container.

13. The rotary filling apparatus of claim 1, wherein said dispensing nozzle includes an orifice having an annular wall that has a truncated conical configuration.

14. The rotary filling apparatus of claim 1, wherein said dispensing nozzle includes an exit orifice, a slidably mounted poppet overlying said exit orifice, and an actuating member for moving said poppet to open and close said orifice.

15. The rotary filling apparatus of claim 14, wherein said actuating member is a pneumatic valve.

16. The rotary filling apparatus of claim 1, wherein said liquid level sensor of the level control chamber is a cone jet sensor.

17. The rotary filling apparatus of claim 1, wherein said liquid level sensor of the level control chamber includes a sensor poppet that is responsive to the level of liquid within the level control chamber.

18. The rotary filling apparatus of claim 1, further including an automatic valve controller in association with the liquid level sensor.

19. A method of the type which uses gravity for filling a liquid into a plurality of containers while they rotate about a rotary filling head, the method comprising:

positioning a container to be filled onto a turntable;

rotating the turntable to bring the container into alignment with a dispensing nozzle;

flowing a predetermined amount of liquid from a reservoir and through the dispensing nozzle while the dispensing nozzle and the reservoir are rotating about a generally vertical axis;

sensing the level of liquid in the rotating reservoir, said sensing step taking place at a sensing location that is spaced from the generally vertical axis by a distance that is substantially the same as the distance between the generally vertical axis and the dispensing nozzle such that centrifugal force at the sensing location is substantially the same as that at said dispensing nozzle during rotation thereof;

adjusting the level of liquid within the rotating reservoir in response to the sensing step, whereby a substantially constant hydraulic head is maintained within the rotating reservoir.

20. The filling method of claim 19, wherein said positioning step includes magnetically grasping the container.

21. The filling method of claim 19, wherein said liquid flowing step includes pneumatically opening an orifice of the dispensing head.

22. The filling method of claim 19, wherein said sensing step includes pneumatically monitoring said level of liquid.

* * * * *